US012655770B2

(12) United States Patent
Kush et al.

(10) Patent No.: US 12,655,770 B2
(45) Date of Patent: Jun. 16, 2026

(54) RADIAL TURBINE ASSEMBLY WITH CERAMIC MATRIX COMPOSITE AIRFOILS HAVING CIRCUMFERENTIAL DOVETAIL RETENTION

(71) Applicant: Rolls-Royce North American Technologies Inc., Indianapolis, IN (US)

(72) Inventors: Matthew T. Kush, Indianapolis, IN (US); Michael D. Wood, Indianapolis, IN (US); Timothy P. Fuesting, Indianapolis, IN (US); Douglas D. Dierksmeier, Indianapolis, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 280 days.

(21) Appl. No.: 18/481,739

(22) Filed: Oct. 5, 2023

(65) Prior Publication Data

US 2025/0116194 A1 Apr. 10, 2025

(51) Int. Cl.

| | |
|---|---|
| ***F01D 5/30*** | (2006.01) |
| ***F01D 5/04*** | (2006.01) |
| ***F01D 5/32*** | (2006.01) |
| *F01D 1/08* | (2006.01) |

(52) U.S. Cl.

CPC ..... *F01D 5/30* (2013.01); *F01D 5/048* (2013.01); *F01D 5/3007* (2013.01); *F01D 5/3038* (2013.01); *F01D 1/08* (2013.01); *F01D 5/3084* (2013.01); *F01D 5/32* (2013.01)

(58) Field of Classification Search

CPC .... F01D 5/3007; F01D 5/3015; F01D 5/3046; F01D 5/3053; F01D 5/3038; F01D 5/3084; F01D 5/30–326; F01D 5/04; F01D 5/043–048; F01D 1/08; F04D 29/22–24; F04D 29/28–628; F05D 2260/36

See application file for complete search history.

(56) References Cited

U.S. PATENT DOCUMENTS

| | | | | |
|---|---|---|---|---|
| 8,814,524 | B2 * | 8/2014 | Krautheim | F04D 29/284 416/220 R |
| 10,267,166 | B2 * | 4/2019 | Cosi | F04D 29/322 |
| 10,641,111 | B2 | 5/2020 | Sippel | |
| 10,655,479 | B2 | 5/2020 | Sippel | |
| 10,787,916 | B2 | 9/2020 | Shi | |
| 10,934,862 | B2 * | 3/2021 | Whittle | F01D 5/284 |
| 10,934,863 | B2 | 3/2021 | Morrison | |
| 11,131,203 | B2 | 9/2021 | Sippel | |
| 11,268,389 | B2 | 3/2022 | Freeman | |
| 2020/0340364 | A1 | 10/2020 | Starr | |

FOREIGN PATENT DOCUMENTS

| | | | |
|---|---|---|---|
| WO | WO-2013102591 A1 * | 7/2013 | F01D 5/32 |

* cited by examiner

*Primary Examiner* — Stephanie Sebasco Cheng
(74) *Attorney, Agent, or Firm* — Barnes & Thornburg

(57) ABSTRACT

A radial turbine rotor incorporating ceramic matrix composite turbine blades is disclosed. The radial turbine rotor can include a dovetail shape retention features for coupling the ceramic matrix composite turbine blades to a central hub.

17 Claims, 3 Drawing Sheets

RADIAL TURBINE ASSEMBLY WITH CERAMIC MATRIX COMPOSITE AIRFOILS HAVING CIRCUMFERENTIAL DOVETAIL RETENTION

FIELD OF THE DISCLOSURE

The present disclosure relates generally to radial turbines, and more specifically to radial turbine rotors.

BACKGROUND

Radial turbine rotors are characterized by rotating in response to a flow of working fluid radially inwardly toward the axis of rotation. In many applications, radial turbine rotors can be more efficient than axial turbine rotors that rotate in response to a flow of working fluid primarily parallel to the axis of rotation.

To increase efficiency of radial turbine rotors, it can be beneficial to increase the temperature of the working fluid that interacts with the rotors. However, manufacturing radial turbine rotors from high temperature materials and/or incorporating an active supply of cooling air into radial turbines presents challenges.

SUMMARY

The present disclosure may comprise one or more of the following features and combinations thereof in an effort to address challenges in radial turbine rotor design and manufacture.

A radial turbine rotor may comprise a hub, a plurality of turbine blades, and an axial retainer. The hub may be arranged around a central axis and may be formed to include an annular shaft portion, a forward flange, and an aft flange. The annular shaft portion, the forward flange, and aft flange of the hub can be shaped to define a dovetail shape channel when viewed circumferentially around the axis. The turbine blades can be made from ceramic matrix composite materials. Each of the plurality of turbine blades can be shaped to include a dovetail root arranged in the dovetail shape channel of the hub and an airfoil that extends radially-outwardly for interaction with hot gasses that flow over the radial turbine rotor during use.

In illustrative embodiments, the aft flange is shaped to include an assembly gap that extends axially into the dovetail shape channel. The assembly gap can be sized to accommodate insertion of a single dovetail root into the dovetail shape channel during assembly of the rotor.

In illustrative embodiments, the retainer is mounted along an aft face of the aft flange to block undesired withdrawal of the turbine blades from the dovetail shape channel. The retainer can include a retention ring and a shaft. The ring can include an annular washer portion and a filler tab that extends from the annular washer portion into the assembly gap of the aft flange. The shaft may be engaged with radially-inwardly facing surfaces of both the hub and the retention ring to couple the turbine rotor components together for rotation about the axis.

In illustrative embodiments, each of the plurality of turbine blades is further formed to include a platform. The platform can extend circumferentially between airfoils of adjacent turbine blades to shield the hub radially inward of the platform. Optionally, the platform can extend aft and radially outward of the aft flange to shield the aft flange of the hub radially inward of the platform.

These and other features of the present disclosure will become more apparent from the following description of the illustrative embodiments.

DETAILED DESCRIPTION OF THE DRAWINGS

Figure 1:
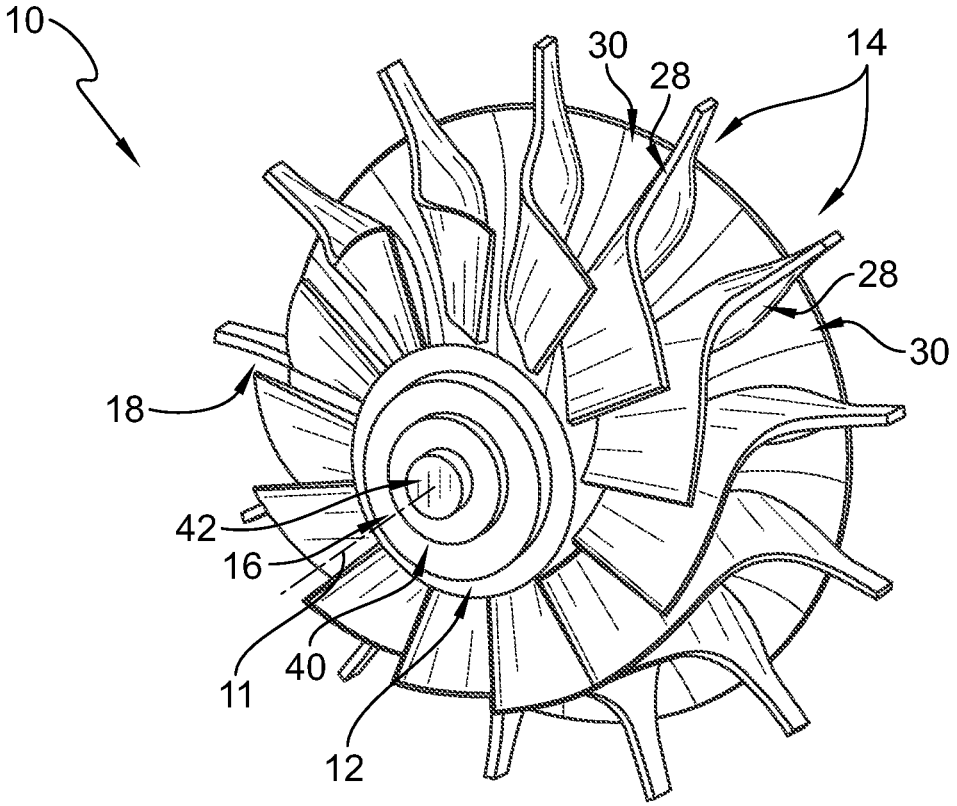
FIG. 1 is a perspective view of a radial turbine rotor assembled from a number of different pieces including turbine blades comprising ceramic matrix composite material suitable for use in high temperature applications.

For the purposes of promoting an understanding of the principles of the disclosure, reference will now be made to a number of illustrative embodiments shown in the drawings and specific language will be used to describe the same.

A radial turbine rotor 10 of the present disclosure is configured to extract energy from a working fluid, such as hot, high pressure combustion products, flowing through a gas path 18. The radial turbine rotor 10 rotates about a central axis 11 to extract mechanical work from the flow of working fluid to drive other components of the gas turbine engine. The flow of working fluid in the radial turbine rotor 10 may be, at least in majority part, radial to the central axis 11.

The radial turbine rotor 10 for use in a gas turbine engine includes a hub 12 made of metallic materials, turbine blades 14 made of ceramic matrix composite materials (CMCs), and a retainer 16. The retainer 16 facilitates coupling of the CMC turbine blades 14 to metallic the hub 12 as shown in FIGS. 1-4.

Figure 2:
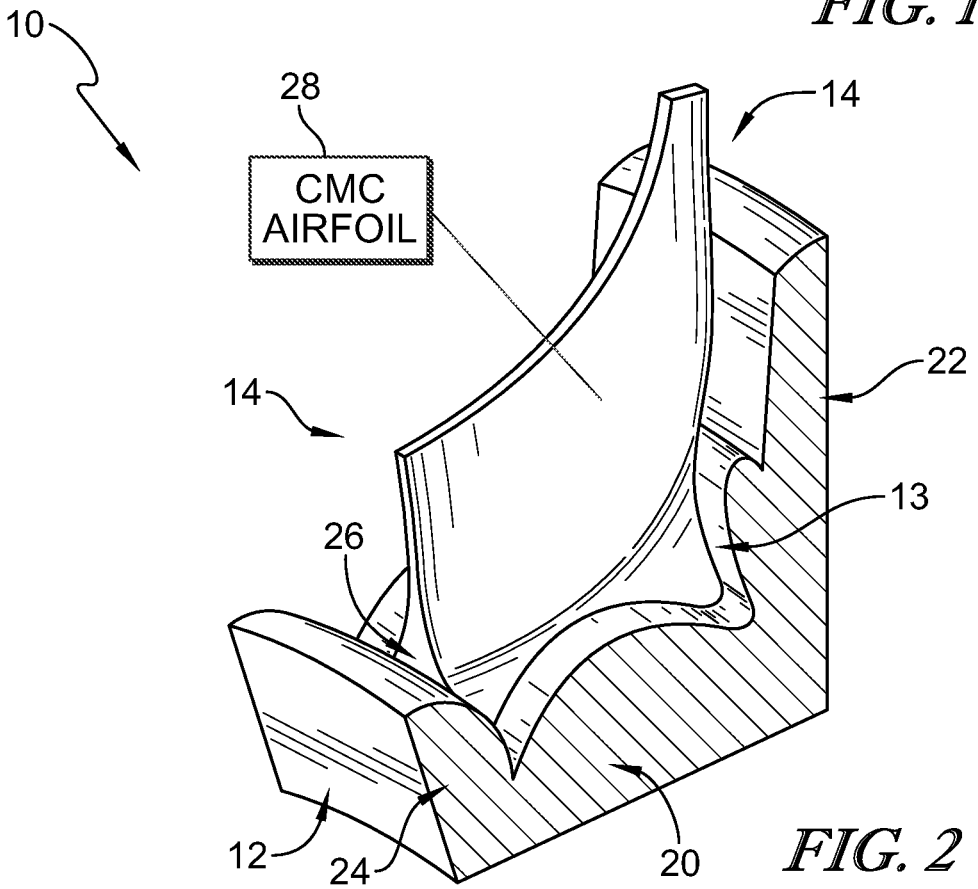
FIG. 2 is a perspective view of a cutaway portion of a radial turbine rotor showing that the rotor includes a hub formed to include a dovetail shape channel that extends circumferentially around the axis and that each of the turbine blades is shaped to form a dovetail root arranged in the dovetail shape channel and an airfoil that extends radially-outwardly for interaction with hot gasses that flow over the radial turbine rotor during use.
Figure 3:
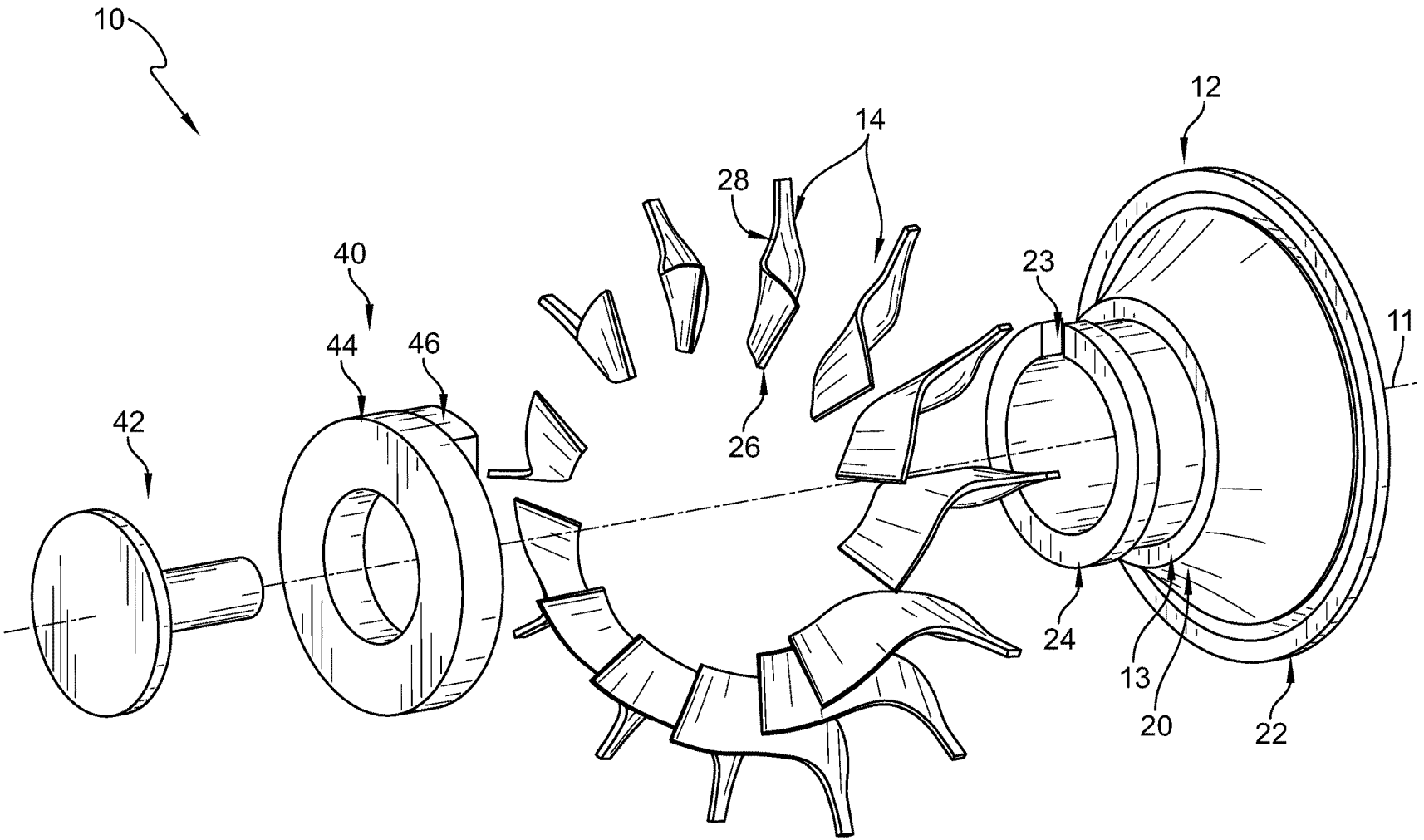
FIG. 3 is an exploded perspective assembly view of a radial turbine rotor showing that the hub is formed to include a flange with an assembly gap that extends axially into the dovetail shape channel to accommodate insertion of the roots of each turbine blade into the dovetail shape channel during assembly, and further showing that a retainer for blocking undesired withdrawal of the turbine blades from the dovetail shape channel is provided by a retention ring and a shaft.

The hub 12 is shaped to have a generally diminishing diameter from a forward end 12F to an aft end 12A as shown in FIGS. 2 and 3. The hub 12 defines a dovetail shape channel 13 when viewed around a central axis 11. The turbine blades 14 are inserted into the channel 13 to couple the blades 14 to the hub 12 without fasteners.

Figure 4:
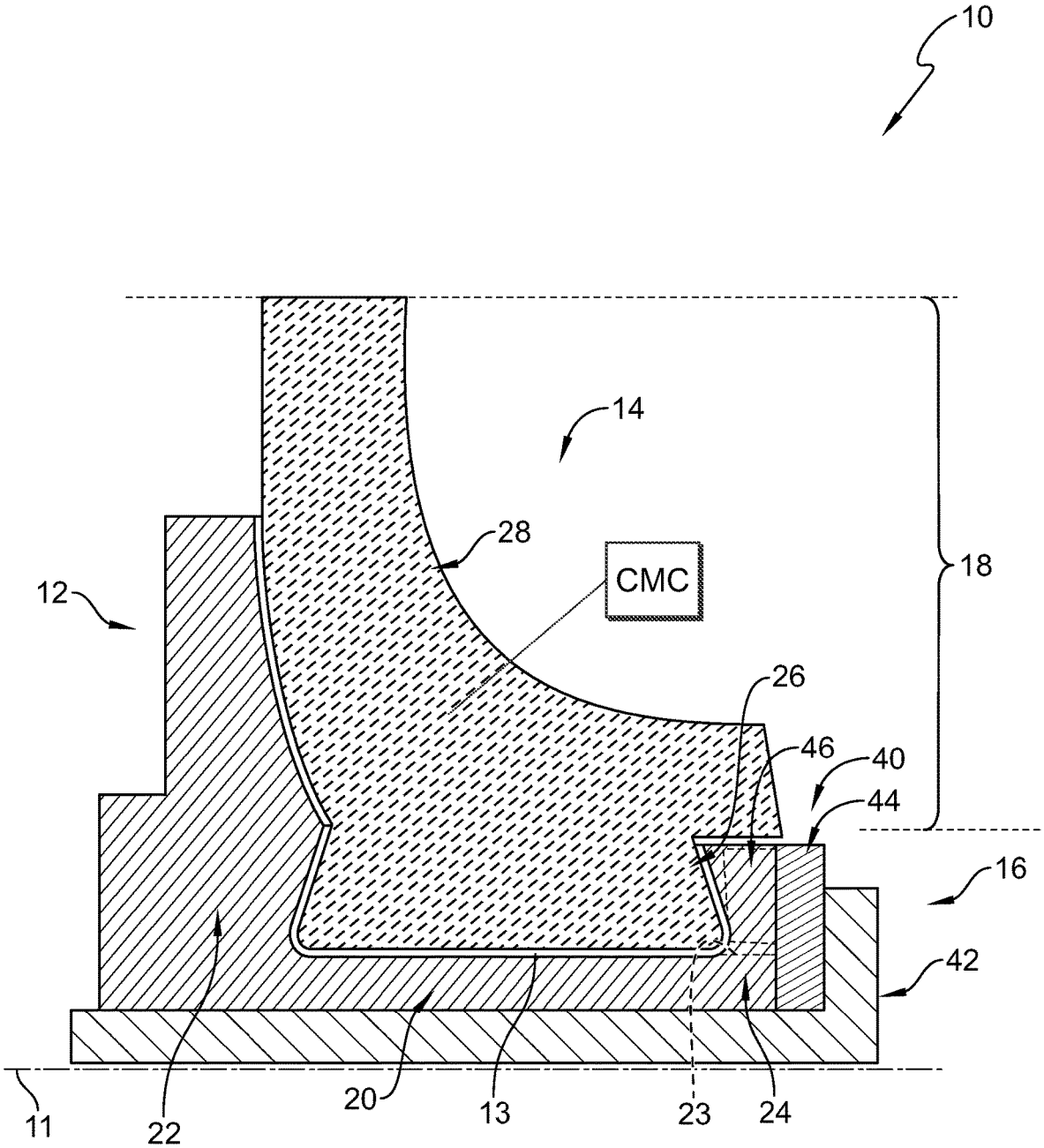
FIG. 4 is a sectional view of a radial turbine rotor showing the retention ring arranged over the assembly gap in the flange included in the hub and showing the shaft engaged with both the hub and the retention ring to couple the turbine rotor components together for rotation about the axis.

In the illustrative embodiment, the hub 12 includes an annular shaft portion 20, a forward flange 22, and an aft flange 24 as shown in FIGS. 3 and 4. The annular shaft portion 20 is arranged around the axis 11. The forward flange 22 extends radially outwardly from the annular shaft portion 20. The aft flange 24 is spaced along the axis 11 from the forward flange 22 and extends radially outwardly from the annular shaft portion 20.

The diameter of the aft flange 24 is smaller than the diameter of the forward flange 22 as shown in FIG. 3. The aft flange 22 is shaped to include an assembly gap 23 that extends axially into the dovetail shape channel 13. The assembly gap 23 is sized to accommodate insertion of a single turbine blade 14 during assembly of the rotor 10.

In some embodiments, the hub 12 comprises nickel superalloy, such as, but not limited to, Udimet 720. In some embodiments, the hub 12 comprises nickel powder alloy, such as, but not limited to, RR1000. In some embodiments, the hub 12 comprises polycrystalline nickel-based superalloy, such as, but not limited to, Mar-M-247. In the illustrative embodiment, the hub 12 is integrally formed (cast/forged/machined) as a single component.

The turbine blades 14 are able to withstand relatively high temperatures on account of the CMC material used to create the blades 14. In the illustrative embodiment, the blades 14 comprise silicon-carbide fibers in a silicon-carbide matrix (SiC—SiC). The turbine blades 14 are coupled to the hub 12 via a dovetail coupling.

Each of the plurality of turbine blades 14 is shaped to include a dovetail root 26 and an airfoil 28 as shown in FIGS. 2-4. The root 26 is arranged in the dovetail shape channel 13 of the hub 12 after insertion through the gap 23. The airfoil 28 extends radially-outward for interaction with hot gasses that flow over the radial turbine rotor 10 during use.

Each of the plurality of turbine blades 14 can be formed to include a platform 30 as shown in FIG. 1. Each of the optional platforms extend circumferentially between airfoils 28 of adjacent turbine blades 14 to shield the hub 12 radially inward of the platform 30. The platforms 30 can also be shaped to extend aft and radially outward of the aft flange 24 to shield the aft flange 24 of the hub 12 radially inward of the platform 30.

The retainer 16 is illustratively mounted along an aft face of the aft flange 24 to block undesired withdrawal of the turbine blades 14 from the dovetail shape channel 13 as shown in FIG. 4. The retainer 16 includes a retention ring 40 and a shaft 42. The retention ring 40 includes an annular washer portion 44 and a filler tab 46 that extends from the annular washer portion 44 into the assembly gap 23 of the aft flange 24. The shaft 42 of the retainer 16 is engaged with radially-inward facing surfaces of both the hub 12 and the retention ring 40 to couple the turbine rotor 10 components together for rotation about the axis 11.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A radial turbine rotor, the radial turbine rotor comprising:

a hub comprising metallic materials and the hub formed to include;

an annular shaft portion arranged around an axis, a forward flange extending radially outward from the annular shaft portion and the forward flange having a first diameter, and an aft flange spaced along the axis from the forward flange, the aft flange extending radially outward from the annular shaft portion, and the aft flange having a second diameter smaller than the first diameter;

wherein the annular shaft portion, the forward flange, and the aft flange of the hub are shaped to define a dovetail shape channel that extends annularly around the axis, a plurality of turbine blades comprising ceramic matrix composite materials, each of the plurality of turbine blades shaped to include a dovetail root arranged in the dovetail shape channel of the hub and an airfoil that extends radially-outward for interaction with hot gases that flow over the radial turbine rotor during use, and a retainer that contacts an aft face of the aft flange to block undesired withdrawal of the plurality of turbine blades from the dovetail shape channel, the retainer including a retention ring that forms a hoop around the axis.

2. The radial turbine rotor of claim 1, wherein the aft flange is shaped to include an assembly gap that extends along the axis and adjoins the dovetail shape channel, the assembly gap sized to accommodate insertion of a single one of the dovetail roots of the plurality of turbine blades into the dovetail shape channel during assembly of the radial turbine rotor.

3. The radial turbine rotor of claim 1, wherein the retention ring includes an annular washer portion that forms the hoop around the axis and a filler tab that extends parallel to the axis from the annular washer portion into the assembly gap of the aft flange.

4. The radial turbine rotor of claim 1, wherein the retainer further includes a shaft coaxial with the axis engaged with radially-inwardmost facing surfaces of both the hub and the retention ring to couple the hub, the plurality of turbine blades, and the retainer together for rotation about the axis.

5. The radial turbine rotor of claim 1, wherein each of the plurality of turbine blades is further formed to include a platform that extends circumferentially between the airfoils of adjacent turbine blades of the plurality of turbine blades to shield the hub radially inward of the platform.

6. The radial turbine rotor of claim 5, wherein each platform of the plurality of turbine blades is shaped to extend aft and radially outward of the aft flange to shield the aft flange of the hub radially inward of the platform.

7. A radial turbine rotor, the radial turbine rotor comprising:

a hub that extends around a central axis, the hub shaped to define a dovetail shape channel that extends annularly around the central axis, a plurality of turbine blades comprising ceramic matrix composite materials, each of the plurality of turbine blades shaped to include a dovetail root, each dovetail root of the plurality of turbine blades arranged in the dovetail shape channel of the hub, and each of the plurality of turbine blades further shaped to include an airfoil that extends radially-outward from the dovetail root, and a retainer mounted axially adjacent to the hub to block withdrawal of the plurality of turbine blades from the dovetail shape channel, the retainer including a retention ring that forms a hoop around the central axis, wherein the hub is shaped to include an assembly gap that extends along the central axis and adjoins the dovetail shape channel, the assembly gap sized to accommodate insertion of a single one of the dovetail roots of the plurality of turbine blades into the dovetail shape channel.

8. The radial turbine rotor of claim 7, wherein the retention ring includes an annular washer portion and a filler tab that extends from the annular washer portion into the assembly gap.

9. The radial turbine rotor of claim 7, wherein the retainer further includes a shaft engaged with radially-inwardmost facing surfaces of both the hub and the retention ring.

10. The radial turbine rotor of claim 7, wherein each of the plurality of turbine blades is further formed to include a platform that extends circumferentially between the airfoils of adjacent turbine blades of the plurality of turbine blades to shield the hub radially inward of the platform.

11. The radial turbine rotor of claim 10, wherein each platform of the plurality of turbine blades is shaped to extend aft and radially outward away from the central axis.

12. The radial turbine rotor of claim 8, wherein the washer portion forms the hoop around the central axis and the filler tab extends parallel to the central axis from the annular washer portion.

13. The radial turbine rotor of claim 7, wherein the retainer further includes a shaft engaged with a radially-inwardmost facing surface of the hub.

14. The radial turbine rotor of claim 13, wherein the shaft is further engaged with the retention ring to couple the hub and the retention ring.

15. The radial turbine rotor of claim 14, wherein the retention ring includes an annular washer portion and a filler tab that extends from the annular washer portion into the assembly gap of the aft flange.

16. A radial turbine rotor comprising:

a hub that extends around a central axis, the hub shaped to define a dovetail shape channel that extends annularly around the central axis, a plurality of turbine blades comprising ceramic matrix composite materials, each of the plurality of turbine blades shaped to include a dovetail root, each dovetail root of the plurality of turbine blades arranged in the dovetail shape channel of the hub, and each of the plurality of turbine blades further shaped to include an airfoil that extends radially-outward from the dovetail root, a retainer including:

a filler tab that extends into an assembly gap formed in the hub, the assembly gap extending axially along the central axis and adjoining the dovetail shape channel, the assembly gap sized to accommodate insertion of a single one of the dovetail roots of the plurality of turbine blades into the dovetail shape channel, a shaft that extends along the central axis, wherein the shaft is engaged with a radially-inwardmost facing surface of the hub and is configured to block movement of the of the filler tab relative to the hub so as to keep the filler tab from moving out of the assembly gap, and a washer portion forming a hoop around the central axis and the shaft further engaged with the washer portion.

17. The radial turbine rotor of claim 16, wherein the filler tab and the washer portion cooperate to form a one-piece retainer ring in which the filler tab extends from the washer portion along the central axis.

* * * * *